US008066533B2

(12) United States Patent
Tomita et al.

(10) Patent No.: US 8,066,533 B2
(45) Date of Patent: Nov. 29, 2011

(54) ELECTRIC DEVICES

(75) Inventors: Akifumi Tomita, Anjo (JP); Tomonobu Nashimoto, Anjo (JP); Eiji Kondo, Anjo (JP); Hitoshi Suzuki, Anjo (JP)

(73) Assignee: Makita Corporation, Anjo-shi (JP)

( * ) Notice: Subject to any disclaimer, the term of this patent is extended or adjusted under 35 U.S.C. 154(b) by 0 days.

(21) Appl. No.: 12/458,724

(22) Filed: Jul. 21, 2009

(65) Prior Publication Data

US 2010/0029139 A1 Feb. 4, 2010

(30) Foreign Application Priority Data

Jul. 31, 2008 (JP) ..... 2008-197830

(51) Int. Cl.
*H01R 26/04* (2006.01)

(52) U.S. Cl. ..... 439/668

(58) Field of Classification Search ..... 439/668, 439/500; 429/99, 100, 122, 163
See application file for complete search history.

(56) References Cited

U.S. PATENT DOCUMENTS

| | | | | |
|---|---|---|---|---|
| 5,792,573 | A | 8/1998 | Pitzen et al. | |
| RE40,848 | E * | 7/2009 | Pitzen et al. | 429/100 |
| 2009/0246611 | A1 * | 10/2009 | Kim | 429/122 |

FOREIGN PATENT DOCUMENTS

| | | |
|---|---|---|
| JP | A-2000-243362 | 9/2000 |
| JP | A-2006-142402 | 6/2006 |

OTHER PUBLICATIONS

Oct. 20, 2010 European Search Report issued in European Patent Application No. 09 009 828.6.

* cited by examiner

*Primary Examiner* — Alexander Gilman
(74) *Attorney, Agent, or Firm* — Oliff & Berridge, PLC

(57) ABSTRACT

An electric device according to the present invention includes a main body portion of the electric device that is designed to be connected to a battery park. A connecting portion for connecting the battery pack is formed to the main body portion of the electric device. A terminal supporting plate having at least a pair of terminals and for connecting terminals of the battery pack is fixed to the connecting portion. The terminals and are arranged on a front surface side of the terminal supporting plate that is exposed from the connecting portion. An electric material component is arranged on a rear surface side of the terminal supporting plate.

15 Claims, 3 Drawing Sheets

ELECTRIC DEVICES

This application claims priority to Japanese patent application serial number 2008-197830, the contents of which are incorporated herein by reference.

BACKGROUND OF THE INVENTION

Field of the Invention

The present invention relates to an electric device that includes a battery pack with a secondary battery and at least two terminals for transmitting an energy stored in the secondary battery.

A known portable electric device (electric tool) is disclosed in Japanese-Laid-Open Patent Publication No. 2006-142402. The known electric tool is provided with a RFID tag that is attached to an inner wall surface of a housing body at a position rearwardly of a motor. The RFID tag is an electric material component composed of a small wireless IC chip and is capable of storing and transmitting information, such as a date of production, a model name, and a name of distributor, to a reader.

Further, a known technique relating to a battery pack of an electric tool is disclosed in Japanese-Laid-Open Patent Publication No. 2000-243362. An electric material component, such as a fuse, is provided within a housing of the battery pack.

However, with the arrangement, in which an electric material component, such as a RFID tag, is attached close to a motor, it may cause a malfunction of the RFID tag due to an influence of a magnetic field produced by the motor. Also, it is not preferable if an electric material component such as a fuse, is arranged within a housing of a battery pack, because a secondary battery is easily affected by heat generated by a fuse blowout.

Therefore, there is a need for electric devices that enable to arrange an electric material component such that, for example, a magnetic field produced by a motor hardly influences on the electric material component and heat does not influence on a secondary battery of a battery pack.

SUMMARY OF THE INVENTION

One aspect according to the present invention relates to an electric device, in which a battery pack of an electric tool is connected to a main body portion of the electric device. The battery pack includes a secondary battery and at least two terminals for transmitting energy stored in the second battery. A connecting portion for connecting the battery pack is formed to the main body portion of the electric device. A terminal supporting plate with at least a pair of terminals, which are connected with the terminals of the battery pack, is fixed to the connecting portion. The terminals are arranged on a front surface side of the terminal supporting plate that is exposed from the connecting portion. An electric material component is arranged on a rear surface side of the terminal supporting plate that is positioned on inner side of the connecting portion.

According to this invention, the connecting portion for connecting the battery pack for the electric tool is formed to the main body portion of the electric device, and the terminal supporting portion is fixed to the connecting portion. The electric material component is arranged on the rear surface side of the terminal supporting plate. Accordingly, because the electric material component is arranged at a distance from a motor etc., disposed within the main body portion of the electric device, the electric material component is hardly affected by a magnetic field produced by the motor etc.

Further, because the electric material component is attached to the terminal supporting plate of the main body portion of the electric device, heat generated by the electric material component such as a fuse, does not influence on the secondary battery within the battery pack.

In one aspect, a recessed portion is formed on a rear surface of a terminal supporting portion for accommodating an electric material component. An opening of the recessed portion is closed with a member, which is disposed over the terminals. With this arrangement, the electric material component can be easily attached and is hardly removed.

In another aspect, an electric material component is designed as a tag for prohibiting unauthorized access or a fuse.

In a further aspect, a main body portion of an electric device includes a bit, a tubular housing main body portion and a grip portion. The housing main body portion accommodates a motor for generating a rotational force to be applied to the bit. The grip portion is formed on a lateral side of the housing main body portion and protrudes in a radially outward direction therefrom. A connecting portion for connecting the battery pack is formed at a protruding end of the grip portion, which is formed to the main body portion of the electric device.

Accordingly, it is possible to place an electric material portion in a farthest position from a motor that is disposed within a main body portion of an electric device.

In a still further aspect, at least a pair of terminals provided to a terminal supporting plate is arranged like a rail.

DETAILED DESCRIPTION OF THE INVENTION

Each of the additional features and teachings disclosed above and below may be utilized separately or in conjunction with other features and teachings to provide improved an electric device. Representative examples of the present invention, which examples utilize many of these additional features and teachings both separately and in conjunction with one another, will now be described in detail with reference to the attached drawings. This detailed description is merely intended to teach a person of skill in the art farther details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

According to the present invention, it is possible to arrange an electric material component of an electric device such that, for example, a magnetic field produced by a motor hardly influences on the electric material component and heat does not influence a secondary battery of a battery pack.

Figure 1:
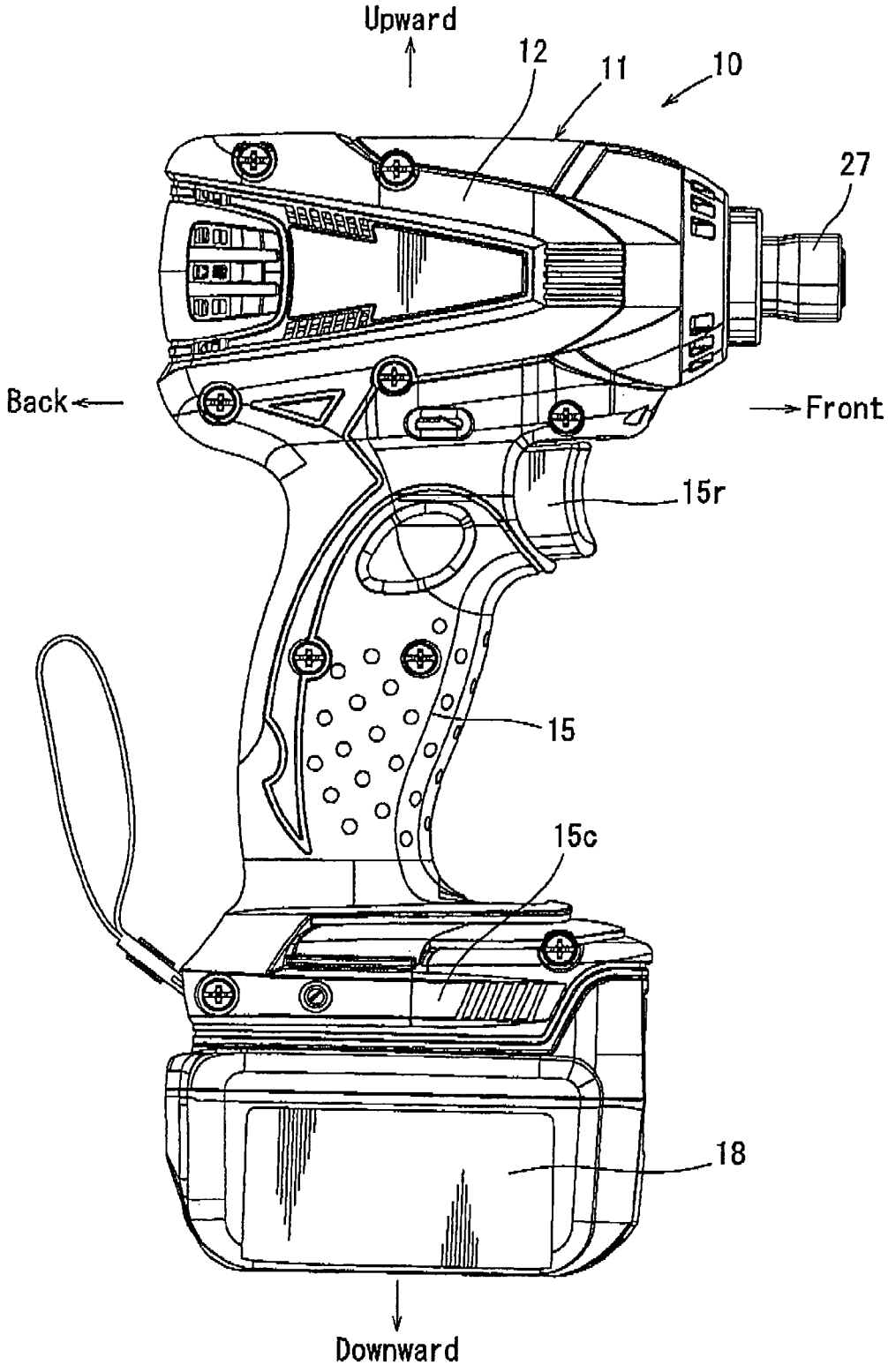
FIG. 1 is an entire side view of an electric tool according to one aspect.
Figure 2:
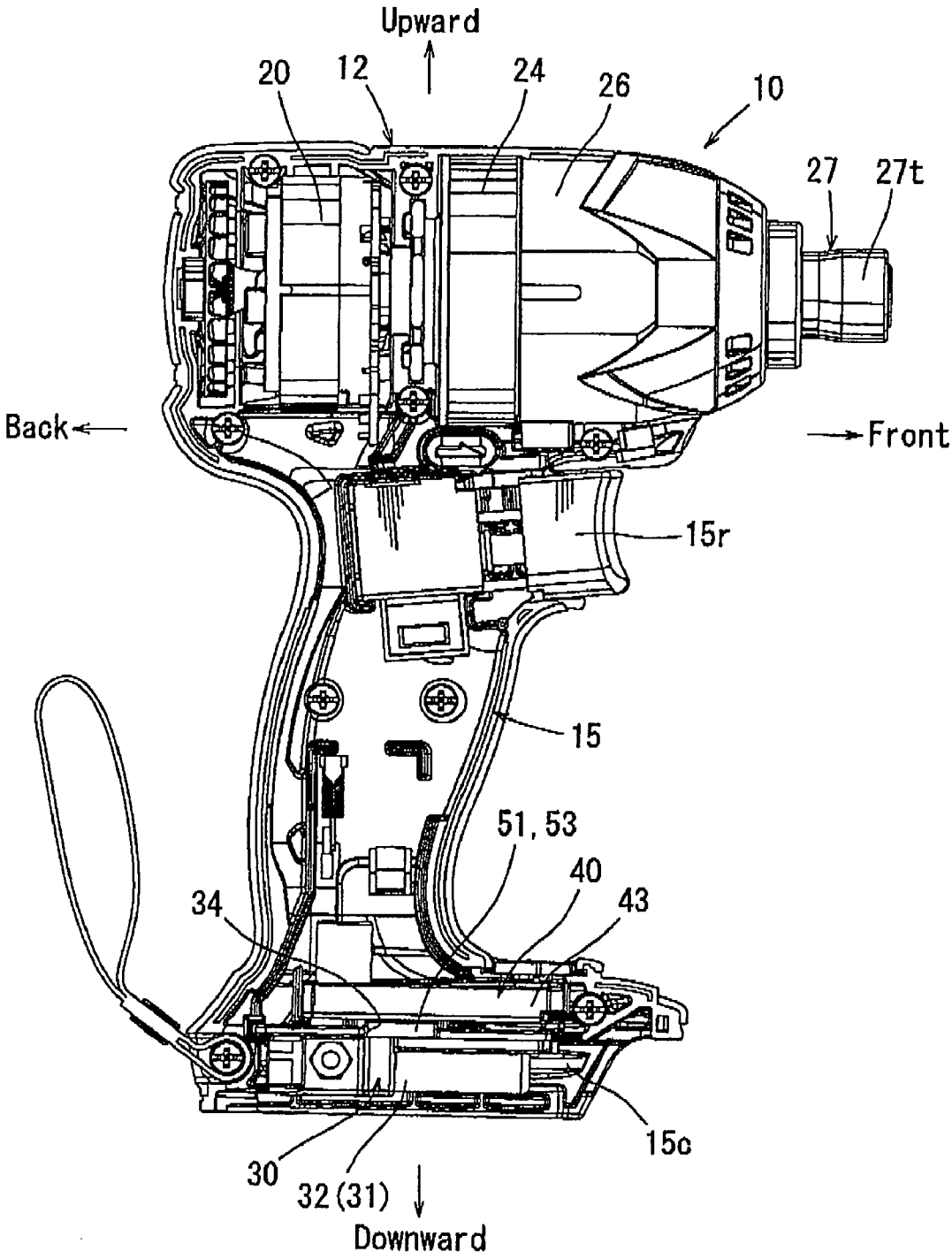
FIG. 2 is a vertical cross sectional view of a main body portion of the electric tool.
Figure 3A:
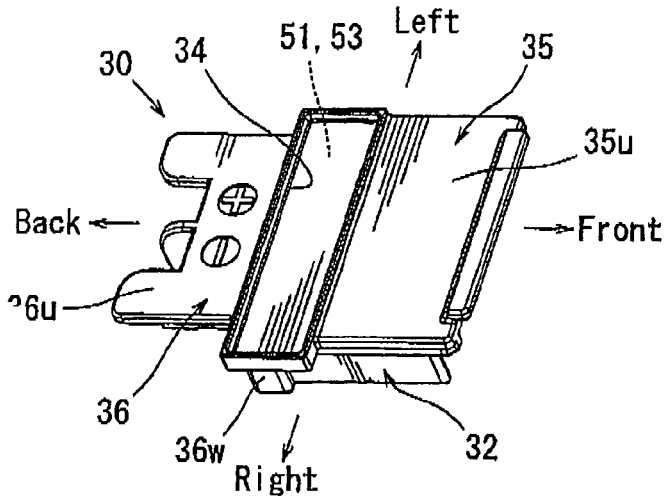
FIGS. 3(A) and 3(B) are perspective views of a terminal supporting plate.
Figure 3B:
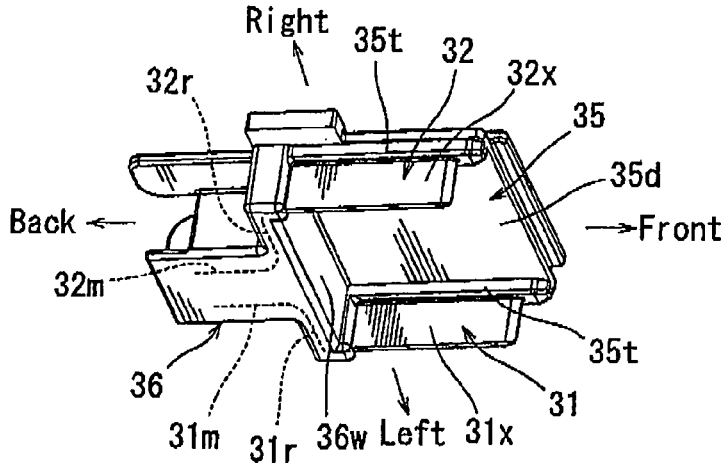
Figure 4:
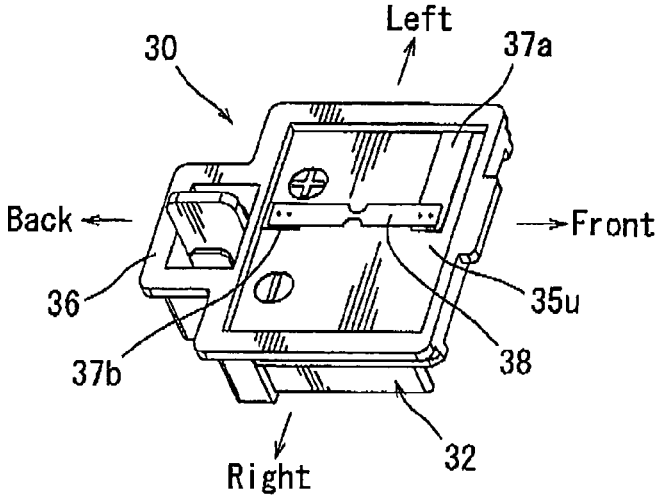
FIG. 4 is a perspective view for illustrating an example of a modification for a terminal supporting plate.

A first aspect of an electric device will now be described with reference to FIGS. 1 to 3. An electric device according to the first aspect is designated as a battery powered impact driver having a motor as a driving source (hereinafter, referred to as an electric tool). FIG. 1 is an entire side view of the electric tool. FIG. 2 is a vertical cross sectional view of a main body portion of the electric tool. FIGS. 3(A) and 3(B) are perspective views of a terminal supporting plate. FIG. 4 is a perspective view for illustrating an example of a modification for a terminal supporting plate.

The directions such as "Front", "Back", "Left", "Right", "Upward" and "Downward" as labeled in the drawings correspond to "Front", "Back", "Left", "Right", "Upward" and "Downward" with respect to the electric tool.

<Electric Tool>

A housing 11 of a main body portion 10 of an electric tool according to the first aspect includes a tubular housing main body portion 12 and a tubular grip portion 15 that is formed to protrude from a side portion (a lower portion in FIG. 1) of the housing main body portion 12 as shown in FIG. 1. A switch lever 15*r*, which is configured as a trigger and is pulled to operate, is arranged on a base end portion of the grip portion 18. A battery pack 18 is connected to an end portion (a protruding end) of the grip portion 15.

As shown in FIG. 2, a motor 20, a planetary gear mechanism 24, a spindle (not shown), an impact force generating mechanism 26 and an anvil 27 are coaxially received within the housing main body portion 12 and arranged in this order as viewed from the backside. A rotational speed of the motor 20 is reduced by the planetary gear mechanism 24 and the rotational movement is then transmitted to the impact force generating mechanism 26 via the spindle. The rotational movement is transformed into a rotational impact force by means of the impact force generating mechanism 26 and is transmitted to the anvil 27. The anvil 27 is a portion that receives a rotational impact force and rotates about an axis. A chuck portion 27*t* is provided to the end portion of the anvil 27 for attaching a bit (not shown), such as a driver bit and a socket bit.

As shown in FIG. 1, a connecting portion 1*c* is formed at an end portion (a lower end portion) of the grip portion 15 for connecting a battery pack 18. As shown in FIG. 2, a terminal supporting plate 30, which has terminals 31 and 32 for connecting power source terminals (not shown) of the battery pack 19, is fixed within the connecting portion 15*c* of the grip portion 15. Further, a case 40 for accommodating an electric circuit board 43 for the motor 20 is mounted to an upper side of the terminal supporting plate 30 and is disposed over the terminal supporting plate 30.

<Terminal Supporting Plate>

The terminal supporting plate 30 is configured as a cover member in order to fix a positive side (left side) terminal 31 and a negative side (right side) terminal 32 to the connecting portion 15*c* of the grip portion 15 in a predetermined position.

As shown in FIG. 3(A), the terminal supporting portion 30 is formed with a rectangular flat plate portion 35 and a terminal portion 36 that is provided one the rear side of the flat plate portion 35. The flat plate portion 35 is configured such that the side of an upper surface 35*u* can be disposed within the grip portion 15. The upper surface 35*u* of the flat plate portion 35 is formed to be positioned at the same level as an upper surface 36*u* of the terminal portion 36. A shallow rectangular recessed portion 34 extends in left and right directions and is formed in a boundary position between the upper surface 35*u* of the flat plate portion 35 and the upper surface 36*u* of the terminal portion 36. The rectangular recessed portion 34 is formed so that electric material components, such as a strip-shaped tag 51 for prohibiting unauthorized access or a RFID tag (radio frequency identification tag) 53, can be fitted into the recessed portion 34. The case 40 for accommodating the electric circuit board 43 of the motor 20 is arranged above the terminal supporting plate 30 while the tag 51 for prohibiting unauthorized access or the RFID tag 53 etc., is received within the rectangular recessed portion 34 so that an opening of the rectangular recessed portion 34 of the terminal supporting plate 30 is closed.

The tag 51 for prohibiting unauthorized access serves to prevent the electric tool from being fraudulently brought out from a store, etc. and is designed to output operation signals for e.g., an alarm when the electric tool is fraudulently brought out.

The RFID tag 53 is an electric material component composed of a small wireless IC chip, and is capable of storing information, such as a date of production, a model name, and a name of distributor, and transmitting the information to a reader or the like.

A lower surface 35*d* of the flat plate portion 35 is a portion that is exposed from the grip portion 15. As shown in FIG. 3(B), the lower surface 35*d* includes a partition wall portion 36*w* extending between the lower surface 35*d* and the terminal portion 36 in left and right directions. Further, protruding ridges 35*t* are formed on both left and right sides of the lower surface 35*d* of the flat portion 35 and extend from the partition wall portion 36*w* to a front end position of the flat plate portion 35. The partition wall portion 36*w* and the left and right protruding ridges 35*t* are designed to support the left and right terminals 31 and 32 and are formed such that the partition wall portion 36*w* is positioned at a level slightly higher than the terminals 31 and 32. In addition, the protrusion ridges 35*t* are designed to have a height, which enables to support upper edges of the terminals 31 and 32.

As shown in FIG. 3(B), the left and right terminals 31 and 32 are symmetrical with each other and are formed by bending strip conductors into substantially Z-shapes in a plan view (see dotted lines). The left terminal 31 has a base end portion 31*m*, a Z-shaped bent portion 31*r* and a tip end portion 31*x*. Similarly, the right terminal 32 has a base end portion 32*m*, a Z-shaped bent portion 32*r* and a tip end portion 32*x*. The Z-shaped bent portions 31*r* and 32*r* of the terminals 31 and 32 are embedded into the partition wall portion 36*w* of the terminal supporting plate 30. Upper edges of the tip end portions 31*x* and 32*x* of the terminals 31 and 31 are embedded into the protruding ridges 35*t* and other parts of the tip end portions 31*x* and 32*x* except their upper edges are exposed to the outside. Thus, the left and right terminals 31 and 32 are fixed to the terminal supporting plate 30 by embedding the Z-shaped bent portions 31*r* and 32*r* of the terminals 31 and 32 into the partition wall portion 36*w* of the terminal supporting plate 30, and by embedding the upper edges of the tip end portions 31*x* and 32*x* into the protruding ridges 35*t* of the terminal supporting plate 30.

Parts of the tip end portions 31*x* and 32*x* of the left and right terminals 31 and 32 exposed to the outside may form a rail to be connected to power source terminals (not shown) of the battery pack 18. The base end portions 31*m* and 32*m* of the left and right terminals 31 and 32 are configured to connect a power source cable (not shown) for the electric circuit board 43 of the motor 20 in a position corresponding to the terminal portion 36 of the terminal supporting plate 30.

The upper surface 35*u* of the terminal supporting plate 30 may correspond to a rear surface of the terminal supporting plate 30 and the lower surface 35*d* of the terminal supporting plate 30 may correspond to the front surface of the terminal supporting plate 30. The case 40 may correspond to a member that is disposed over the terminal supporting plate 30.

According to the electric tool 10 of this aspect, electric material components, such as the tag 51 for prohibiting unauthorized access or the RFID tag 53, are attached on the side of the rear surface (upper surface 35*u*) of the terminal supporting plate 30, which is positioned on the inner side of the protruding end of the grip portion 15. Therefore, the electric material components, such as the tag 51 for prohibiting unauthorized access are positioned away from the motor 20 that is accommodated within the housing main body portion 12. Consequently, the tag 51, etc. may hardly be influenced by the magnetic field generated by the motor 20, and thus a risk of malfunction is reduced.

The rectangular recessed portion 34 is formed on the rear surface (upper surface 35*u*) of the terminal supporting plate 30 for receiving the electric material components. The opening of the recessed portion 34 is closed with the case 40 for the electric circuit board 43 that is disposed over the terminal supporting plate 30. Therefore, the electric material component(s) is easily attached and is difficult to be accidentally removed.

The present invention is not to be limited to the above-aspect but may be modified within the scope of the subject matter of the present invention. For example, the present aspect shows an example for attaching an electric material component(s), such as a tag 51 for prohibiting unauthorized access or the RFID tag 53, on the side of the upper surface 35*u* of the terminal supporting plate 30. However, as shown in FIG. 4, for example, a fuse 38 may be used to be attached instead of the tag 51 or the RFID tag 53. In this case, the fuse 38 attached on the upper surface 35*u* of the terminal supporting plate 30 and the terminal 31 arranged on the lower surface of the terminal supporting plate 30 and the terminal portion (not shown) are connected in series by using conductive wires 37*a* and 37*b*. Because the fuse 38 is designed to be attached on the side (upper surface 35*u*) opposite to the surface arranged with the terminal (lower surface), even if the fuse 38 is fused, the heat generated by fusing is blocked by the terminal supporting plate 30 so that the heat does not influence the secondary battery of the battery pack 18.

Further, it is also possible to arrange other electric material components such as a resistor, a coil or a condenser on the upper surface 35*u* of the terminal supporting plate 30 instead of the fuse 38.

Also, the present aspect illustrated an example to cover the recessed portion 34 with the case 40 of the electric circuit board 43 after the tag 51 for prohibiting unauthorized access etc. is received in the recessed portion 34 of the terminal supporting plate 30. However, it is also possible to use, for example, a rib(s) etc., that may be formed to the housing 11 instead of covering with the case 40.

In the present aspect, a battery powered impact driver is illustrated as one example of the electric devices. However, it is also possible to apply the present invention to, for example, a battery powered drill, a circular saw, a laser marker or a light.

What is claimed is:

1. An electric device having a main body portion capable of connecting to a battery pack that has a secondary battery and at least two terminals for transmitting an energy stored in the secondary battery, comprising:

a connecting portion provided on the main body portion for connecting the battery pack; and a terminal supporting plate fixed to the connecting portion and having at least a pair of terminals for connecting terminals of the battery pack; wherein the terminals of the terminal supporting plate are arranged on a front surface side of the terminal supporting plate that is exposed from the connecting portion;

the terminals are embedded into the terminal supporting plate so as to be integrated therewith;

an electric material component is arranged on a rear surface side of the terminal supporting plate; and the electric material component comprises a tag for prohibiting unauthorized access, a RFID tag, or a fuse.

2. The electric device as defined in claim 1, wherein a recessed portion for receiving the electric material component is formed on the rear surface of the terminal supporting plate, and an opening of the recessed portion is closed with a member, which is disposed over the terminal supporting plate.

3. The electric device as defined in claim 2, wherein the main body portion of the electric device includes a bit, a tubular housing main body portion for accommodating a motor for generating a rotational force to be applied to the bit and a grip portion formed on a lateral side of the housing main body portion and protruding in a radially outward direction therefrom;

wherein the connecting portion for connecting the battery pack is formed at a protruding end of the grip portion, which is formed to the main body portion of the electric device.

4. The electric device as defined in claim 2, wherein the at least a pair of terminals provided to the terminal supporting plate is arranged like a rail.

5. The electric device as defined in claim 1, wherein the main body portion of the electric device includes a bit, a tubular housing main body portion for accommodating a motor for generating a rotational force to be applied to the bit and a grip portion formed on a lateral side of the housing main body portion and protruding in a radially outward direction therefrom;

wherein the connecting portion for connecting the battery pack is formed at a protruding end of the grip portion.

6. The electric device as defined in claim 5, wherein the at least a pair of terminals provided to the terminal supporting plate is arranged like a rail.

7. The electric device as defined in claim 1, wherein the at least a pair of terminals provided to the terminal supporting plate is arranged like a rail.

8. The electric device as defined in claim 1, wherein the at least a pair of terminals provided to the terminal supporting plate is arranged like a rail.

9. An electric device having a main body portion capable of connecting to a battery pack that has a secondary battery comprising:

a connecting portion provided on the main body portion for connecting the battery pack; and a terminal supporting plate having at least a pair of terminals and fixed to the connecting portion; wherein the terminals of the terminal supporting plate are arranged on a front surface side of the terminal supporting plate that is exposed from the connecting portion;

the terminals are embedded into the terminal supporting plate so as to be integrated therewith;

an electric material component is arranged on a rear surface side of the terminal supporting plate; and the electric material component comprises a tag for prohibiting unauthorized access, a RFID tag, or a fuse.

10. The electric device as defined in claim 9, wherein a recessed portion for receiving the electric material component is formed on the rear surface of the terminal supporting plate, and an opening of the recessed portion is closed with a member, which is disposed over terminal supporting plate.

11. The electric device as defined in claim 9, wherein the main body portion of the electric device includes a bit, a tubular housing main body portion for accommodating a motor for generating a rotational force to be applied to the bit and a grip portion formed on a lateral side of the housing main body portion and protruding in a radially outward direction therefrom.

12. The electric device as defined in claim 11, wherein a connecting portion for connecting the battery pack is formed at a protruding end of the grip portion, which is formed to the main body portion of the electric device.

13. The electric device as defined in claim 9, wherein at least a pair of terminals provided to the terminal supporting plate is arranged like a rail.

14. An electric device having a main body portion capable of connecting to a battery pack that has a secondary battery and at least two terminals for transmitting an energy stored in the secondary battery, comprising:

a connecting portion provided on the main body portion for connecting the battery pack; and a terminal supporting plate fixed to the connecting portion and having at least a pair of terminals for connecting terminals of the battery pack; wherein the terminals of the terminal supporting plate are arranged on a front surface side of the terminal supporting plate that is exposed from the connecting portion;

an electric material component is arranged on a rear surface side of the terminal supporting plate;

the electric material component comprises a tag for prohibiting unauthorized access, a RFID tag, or a fuse;

a recessed portion for receiving the electric material component is formed on the rear surface of the terminal supporting plate, and an opening of the recessed portion is closed with a member, which is disposed over the terminal supporting plate; and the member disposed over the terminal supporting plate for enclosing the recessed portion is a case accommodating an electric circuit board of the motor.

15. An electric device having a main body portion capable of connecting to a battery pack that has a secondary battery comprising:

a connecting portion provided on the main body portion for connecting the battery pack; and a terminal supporting plate having at least a pair of terminals and fixed to the connecting portion; wherein the terminals of the terminal supporting plate are arranged on a front surface side of the terminal supporting plate that is exposed from the connecting portion;

an electric material component is arranged on a rear surface side of the terminal supporting plate;

the electric material component comprises a tag for prohibiting unauthorized access, a RFID tag, or a fuse;

a recessed portion for receiving the electric material component is formed on the rear surface of the terminal supporting plate, and an opening of the recessed portion is closed with a member, which is disposed over terminal supporting plate; and the member disposed over the terminal supporting plate for enclosing the recessed portion is a case accommodating an electric circuit board of the motor.

* * * * *